US005854774A

United States Patent [19]

Timme

[11] Patent Number: 5,854,774

[45] Date of Patent: Dec. 29, 1998

[54] MEDICAL TIMING SYSTEM

[76] Inventor: Lissa A. Timme, 5335 N. 525 W., LaPorte, Ind. 46350

[21] Appl. No.: 680,018

[22] Filed: Jul. 15, 1996

[51] Int. Cl.[6] ..... G04B 47/00; G04B 37/00; G04F 8/00

[52] U.S. Cl. ..... 368/10; 368/108; 368/110; 368/276

[58] Field of Search ..... 368/10, 107–113; 221/2, 3, 15; 128/687, 695, 697

[56] References Cited

U.S. PATENT DOCUMENTS

| | | | |
|---|---|---|---|
| 4,293,845 | 10/1981 | Villa-Beal | 540/309.3 |
| 4,451,158 | 5/1984 | Selwin et al. | 368/63 |
| 4,626,105 | 12/1986 | Miller | 368/10 |
| 4,768,176 | 8/1988 | Kehr et al. | 368/10 |
| 4,797,864 | 1/1989 | Stand et al. | 368/111 |
| 4,949,320 | 8/1990 | Karrenberg | 368/109 |
| 5,020,037 | 5/1991 | Bauen | 368/10 |
| 5,088,071 | 2/1992 | Miyamoto et al. | 368/10 |
| 5,327,403 | 7/1994 | Bond | 368/107 |
| 5,438,555 | 8/1995 | Kim | 368/10 |
| 5,602,802 | 2/1997 | Leigh-Spencer | 368/10 |
| 5,646,912 | 7/1997 | Cousin | 368/10 |

FOREIGN PATENT DOCUMENTS

| | | | |
|---|---|---|---|
| 2042775 | 9/1980 | United Kingdom | 368/107 |

*Primary Examiner*—Vit Miska

[57] ABSTRACT

A Medical Timing System for assisting medical personnel in providing efficient and safe medical care to patients while decreasing the level of stress experienced by said medical personnel by means of allowing the medical personnel to monitor up to five different patient activities simultaneously. The device includes a housing structure, a power supply positioned within the housing structure, and a timing means electronically connected to the power supply and attached to the housing structure.

1 Claim, 3 Drawing Sheets

MEDICAL TIMING SYSTEM

BACKGROUND OF THE INVENTION

1. Field of the Invention

The present invention relates to Medical Devices and more particularly pertains to a new Medical Timing System for assisting medical personnel in providing efficient and safe medical care to patients while decreasing the level of stress experienced by said medical personnel by means of allowing the medical personnel to monitor up to five different patient activities simultaneously.

2. Description of the Prior Art

The use of Medical Devices is known in the prior art. More specifically, Medical Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Medical Devices include U.S. Pat. No. 4,225,852; U.S. Pat. No. 4,942,544; U.S. Design Pat. No. 347,583; U.S. Pat. No. 4,975,824; U.S. Pat. No. 4,686,998 and U.S. Pat. No. 4,129,125.

While these devices fulfill their respective, particular objectives and requirements, the aforementioned patents do not disclose a new Medical Timing System. The inventive device includes a housing structure, a power supply positioned within the housing structure, and a timing means electronically connected to the power supply and attached to the housing structure.

In these respects, the Medical Timing System according to the present invention substantially departs from the conventional concepts and designs of the prior art, and in so doing provides an apparatus primarily developed for the purpose of assisting medical personnel in providing efficient and safe medical care to patients while decreasing the level of stress experienced by said medical personnel by means of allowing the medical personnel to monitor up to five different patient activities simultaneously.

SUMMARY OF THE INVENTION

In view of the foregoing disadvantages inherent in the known types of Medical Devices now present in the prior art, the present invention provides a new Medical Timing System construction wherein the same can be utilized for assisting medical personnel in providing efficient and safe medical care to patients while decreasing the level of stress experienced by said medical personnel by means of allowing the medical personnel to monitor up to five different patient activities simultaneously.

The general purpose of the present invention, which will be described subsequently in greater detail, is to provide a new Medical Timing System apparatus and method which has many of the advantages of the Medical Devices mentioned heretofore and many novel features that result in a new Medical Timing System which is not anticipated, rendered obvious, suggested, or even implied by any of the prior art Medical Devices, either alone or in any combination thereof.

To attain this, the present invention generally comprises a housing structure, a power supply positioned within the housing structure, and a timing means electronically connected to the power supply and attached to the housing structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new Medical Timing System which may be easily and efficiently manufactured and marketed.

It is a further object of the present invention to provide a new Medical Timing System which is of a durable and reliable construction.

An even further object of the present invention is to provide a new Medical Timing System which is susceptible of a low cost of manufacture with regard to both materials and labor, and which accordingly is then susceptible of low prices of sale to the consuming public, thereby making such Medical Timing System economically available to the buying public.

Still yet another object of the present invention is to provide a new Medical Timing System which provides in the apparatuses and methods of the prior art some of the advantages thereof, while simultaneously overcoming some of the disadvantages normally associated therewith.

Still another object of the present invention is to provide a new Medical Timing System for assisting medical personnel in providing efficient and safe medical care to patients while decreasing the level of stress experienced by said medical personnel by means of allowing the medical personnel to monitor up to five different patient activities simultaneously.

Yet another object of the present invention is to provide a new Medical Timing System which includes a housing structure, a power supply positioned within the housing structure, and a timing means electronically connected to the power supply and attached to the housing structure.

Even still another object of the present invention is to provide a new Medical Timing System wherein the user is able to monitor up to five patient activities simultaneously.

Still another object of the present invention is to provide a new Medical Timing System that has preset times for common medical activities.

Another object of the present invention is to programmable by the user.

Still another object of the present invention is to provide a new Medical Timing System that reduces the hectic schedules of medical personnel.

Further another object of the present invention is to provide a new Medical Timing System where the programmed settings can not be reset by accidental engagement of the time set buttons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
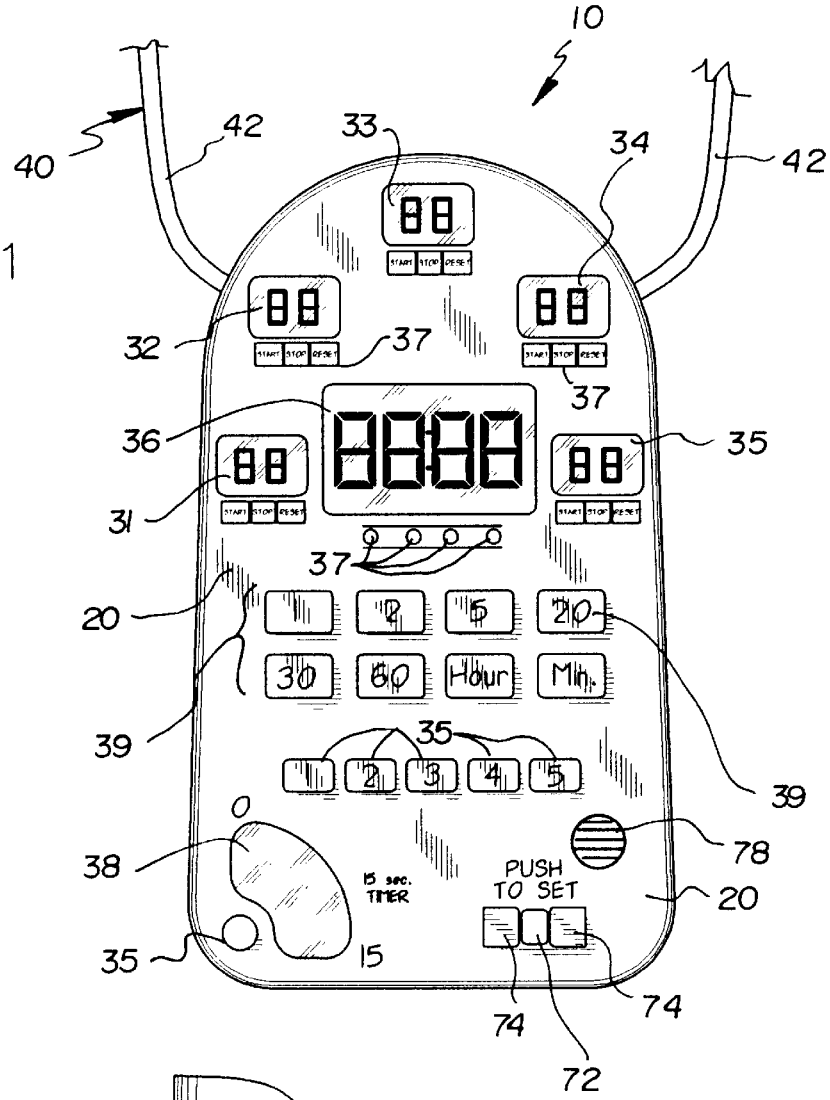
FIG. 1 is a front view of a new Medical Timing System displaying the timing means according to the present invention.

With reference now to the drawings, and in particular to FIGS. 1 through 6 thereof, a new Medical Timing System embodying the principles and concepts of the present invention and generally designated by the reference numeral 10 will be described.

More specifically, it will be noted that the Medical Timing System 10 comprises a housing structure 20 substantially rectangular with liberal radius corners, a power supply 50 secured within the housing structure 20, a timing means 30 electronically connected to the power supply 50 and secured to the housing structure 20, and a securing means 40 mounted to the rear exterior surface of the housing structure 20.

Figure 2:
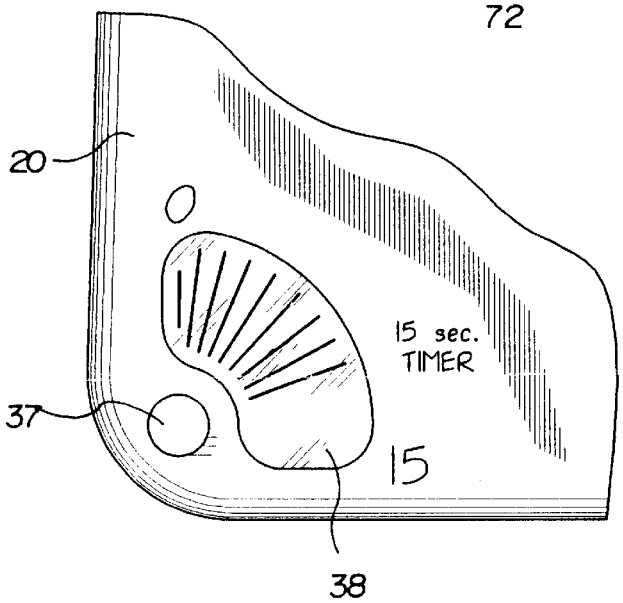
FIG. 2 is a magnified view of the HR-RR LED timer of FIG. 1.
Figure 3:
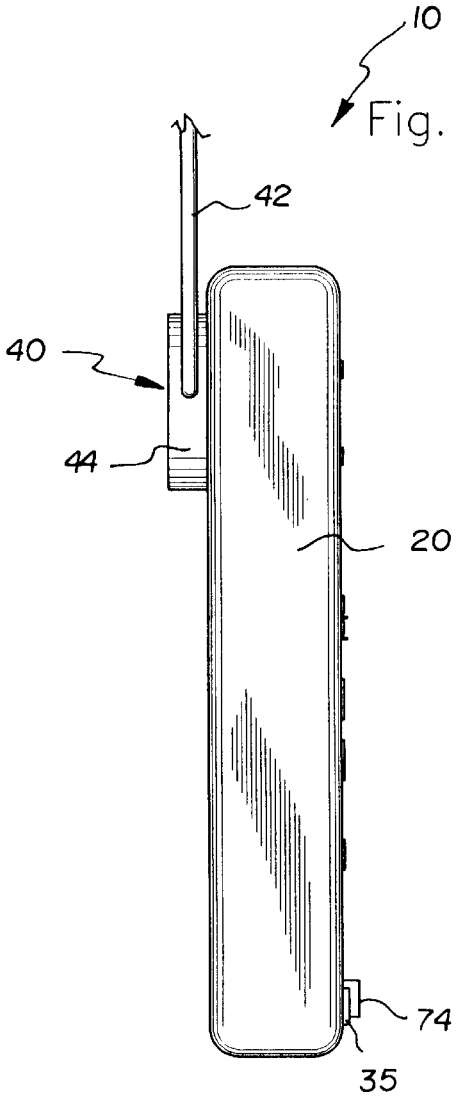
FIG. 3 is a side view of the present invention disclosing the necklace coupler and flexible necklace member.
Figure 4:
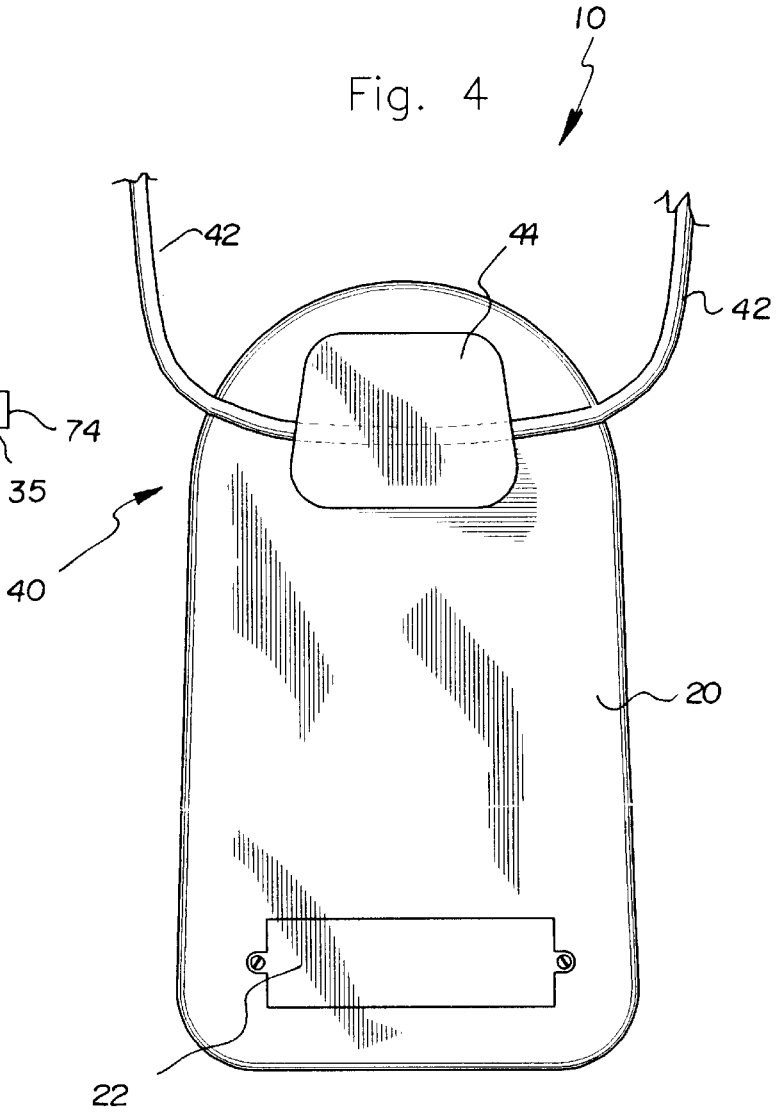
FIG. 4 is a rear view of the invention further displaying the securing means and the power source door.
Figure 5:
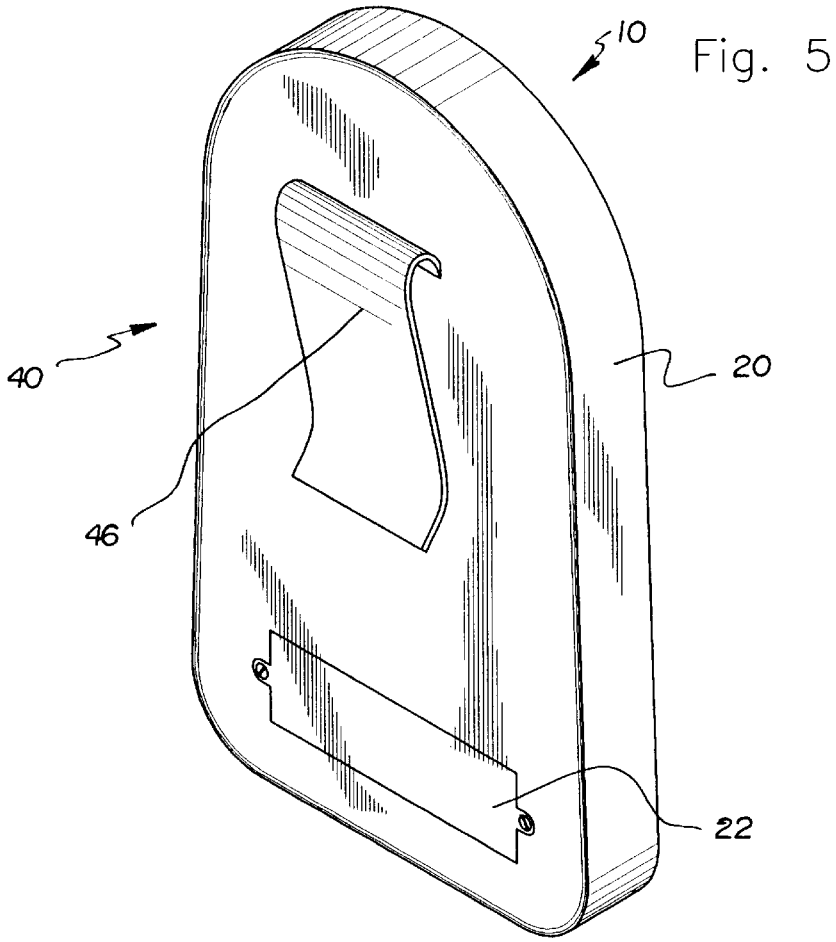
FIG. 5 is an upper right perspective view of the present invention disclosing a belt clip secured to the rear of the housing structure.
Figure 6:
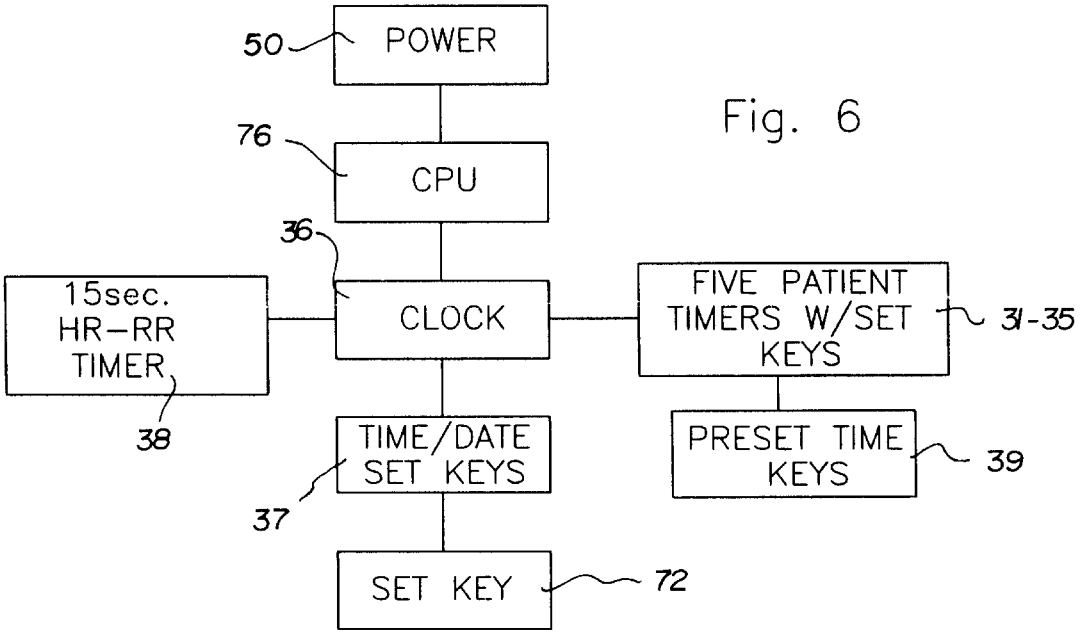
FIG. 6 is a schematic diagram of the timing means of the present invention.

As best illustrated in FIGS. 1 through 6, it can be shown that the housing structure 20 includes a power source door 22 positioned in the lower rear portion. The timing means 30 includes a central processing unit 76 electronically connected to the power supply 50. A plurality of time set buttons 37 are electronically connected to the central processing unit 76 as best shown in FIG. 1 of the drawings. A plurality of preset time buttons 39 are electronically connected to the central processing unit 76. A first LED display 31 is electronically connected to the central processing unit 76. A second LED display 32 is electronically connected to the central processing unit 76. Further, a third LED display 33 is electronically connected to the central processing unit 76. A start button 79 and a stop button 80 are associated with said alphanumeric LED displays. A fourth LED display 34 is electronically connected to the central processing unit 76. A fifth LED display 35 is electronically connected to the central processing unit 76. A central LED clock 36 is electronically connected to the central processing unit 76 as best shown in FIG. 1 of the drawings. An HR-RR LED display 38 is electronically connected to the central processing unit 76. A set key 72 is electronically connected to the central processing unit 76 preventing accidental manipulation of programmed information into the central processing unit 76. The set key 72 is protected by at least one set button guard 74 near the set key 72 as best shown in FIG. 1 of the drawings. The securing means 40 includes a necklace coupler 44 mounted to the rear surface of the housing structure 20 as best shown in FIGS. 2–3 of the drawings. A flexible loop member 42 is secured to the necklace coupler 44 which wraps around the user's neck during use. An alternative securing means 40 includes a belt clip 46 secured to the rear surface of the housing structure 20 as shown in FIG. 5 of the drawings.

In use, the user programs the central processing unit 76 by first pressing the set key 72 first to allow the user to program the central processing unit 76. The user then presses the plurality of time set buttons 37 to set the preferred time for each individual timer. The user then presses the set key 72 again to start the timing and to prevent accidental bumping of the time set buttons 37. If the user requires a fifteen second timer, the user may activate the HR-RR LED display 38 which counts the fifteen seconds. When the central processing unit 76 determines that one of the timers have expired, it activates a speaker 78 which gains the user's attention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A medical timing system comprising:

a housing structure substantially rectangular with radiused corners;

a power supply secured within the housing structure, said power source comprising a replaceable battery;

a timing means electronically connected to the power supply and secured to the housing structure; and a securing means mounted to the rear exterior surface of the housing structure, said securing means comprising includes a belt clip secured to the rear surface of the housing structure;

wherein the housing structure includes a power source door positioned in the lower rear portion permitting replacement of the replaceable battery; and wherein the timing means includes:

a central processing unit electronically connected to the power supply;

a plurality of time set buttons electronically connected to the central processing unit;

a plurality of preset time buttons electronically connected to the central processing unit, one of said preset time buttons setting a one unit time period, one of said preset time buttons setting a five unit time period, one of said preset time buttons setting a twenty unit time period, one of said preset time buttons setting a thirty unit time period, and one of said preset time buttons setting a sixty unit time period, each of said preset time buttons having indicia thereon corresponding to the time period of the preset time button;

a speaker electronically connected to the central processing unit;

an alphanumeric display comprising:

a first LED display eletronically connected to the central processing unit;

a second LED display electronically connected to the central processing unit;

a third LED display electronically connected to the central processing unit;

a fourth LED display electronically connected to the central processing unit; and a fifth LED display electronically connected to the central processing unit;

a start button, a stop button, and a reset button associated with each of said first, second, third, fourth and fifth LED displays;

a central LED clock electronically connected to the central processing unit;

an HR-RR LED display electronically connected to the central processing unit; and a set key electronically connected to the central processing unit adapted to prevent accidental manipulation of programmed information into the central processing unit, whereby the set key is protected by at least one set button guard near the set key.

* * * * *